United States Patent [19]

Bolea Camprubi

[11] 4,132,249

[45] Jan. 2, 1979

[54] WEFT SELECTION AND RETENTION MECHANISM FOR SHUTTLELESS LOOMS

[75] Inventor: D. Anselmo Bolea Camprubi, Barcelona, Spain

[73] Assignee: Incotex S.A., Barcelona, Spain

[21] Appl. No.: 718,160

[22] Filed: Aug. 27, 1976

Related U.S. Application Data

[63] Continuation-in-part of Ser. No. 531,773, Dec. 11, 1974.

[30] Foreign Application Priority Data

Dec. 18, 1973 [ES] Spain ..... 198.918
Dec. 18, 1973 [ES] Spain ..... 198.920

[51] Int. Cl.[2] ..... D03D 47/38; D03D 47/12
[52] U.S. Cl. ..... 139/453; 139/194
[58] Field of Search ..... 139/453, 450, 194

[56] References Cited

U.S. PATENT DOCUMENTS 3,315,707 4/1967 Scheffel ..... 139/453
3,548,886 12/1970 Scherillo ..... 139/453

FOREIGN PATENT DOCUMENTS 2130696 8/1973 Fed. Rep. of Germany ..... 139/453
488036 5/1970 Switzerland ..... 139/194

*Primary Examiner*—Henry S. Jaudon
*Attorney, Agent, or Firm*—Toren, McGeady and Stanger

[57] ABSTRACT

A loom operating without a shuttle is provided with a weft selection mechanism and a weft retention mechanism with the former operating to select a weft thread and pass it through the sheds of the loom while the latter mechanism retains and holds the weft thread during loom operation. The weft selection mechanism includes a plurality of pivotable weft selector arms having a weft thread engaged at a first end thereof and an actuating mechanism oprating to drive a second end of the selector arms. A plurality of selector arms is provided with the first end of each of the arms passing through a common point during pivotal movement of the arms. The arms are pivotally mounted intermediate their first and second ends and a selector device is provided to selectively engage the second end of a particular arm with the actuating mechanism driving the arm through pivotal motion, thereby to effect selection of a weft thread. The retention mechanism includes a suction nozzle which engages a selected weft thread and holds the thread by operation of suction force with gripping threads actuated by a lever causing the weft threads to become engaged in the nozzle with the nozzle holding the weft threads while the gripping threads are released therefrom to engage other weft threads which are to be brought into nozzle engagement. The suction nozzle formed as part of the weft thread retention mechanism is transversely movable across the apparatus during operation thereof.

5 Claims, 7 Drawing Figures

WEFT SELECTION AND RETENTION MECHANISM FOR SHUTTLELESS LOOMS

The present application is a Continuation-in-Part of prior application Ser. No. 531,773, filed Dec. 11, 1974.

BACKGROUND OF THE INVENTION

The present invention relates generally to improvements in looms and more particularly, the invention is related to mechanisms for selection and retention of weft threads in looms operating without a shuttle. By utilization of the mechanisms which constitute the improvements of the present invention, advantageous loom operation may be attained without detrimentally affecting the correct action of other elements of the loom.

It is known that one of the more significant advantages which looms operating without a shuttle have over other existing classic looms is that of being capable of selecting in each pick the weft which is to be used. Since the latter must always pass discontinuously, i.e., each time that the driver passes the weft, a cut must be made in order for it to transmit the end of the weft. Consequently, if a weft selector is available, it may be utilized to supply threads in accordance with a predetermined program consistent with preestablished needs relating both to color and type.

The present invention is aimed at providing improvements in the means for selecting and retaining weft threads whereby there may be achieved advantageous functional characteristics over presently known devices.

SUMMARY OF THE INVENTION

Briefly, the present invention may be described as including apparatus for selecting and retaining weft threads in a loom operating without a shuttle. The weft selection apparatus comprises a plurality of weft selector arms, each having a first end in engagement with a weft thread and a second end, means pivotally mounting each of said arms at a point intermediate said first and second ends, with said plurality of arms arranged to have said first end of each arm pass through a common point during pivotal movement about said intermediate point, an actuating mechanism adapted to be selectively brought into engagement with said second end of each of said weft selector arms to drive said arms through pivotal motion about said intermediate point, and selector means for selectively individually engaging each of said arms with said actuating mechanism for driving engagement therewith, with pivotal motion of said arms as a result of selective engagement with said actuating mechanism operating to effect selection of a weft thread in engagement with said first end of said selected arm.

The selected weft thread may then be extracted and positioned by a driver of the apparatus which operates to incorporate the selected weft thread as the weft of the fabric to be manufactured. For this purpose, articulation of all of the arms is made dependent upon the requirement that their axis adopt the form of an arm having a certain curvature so that, as previously mentioned, the free end of each arm will always converge at a common point.

After the driver passes the selected weft thread through the sheds of the loom, the thread is engaged and retained by the weft retention mechanism which comprises means defining a suction orifice within which the weft threads are held by suction force supplied thereto. The apparatus includes means mounting said retention mechanism for transverse movement relative to the apparatus and means for providing gripping threads. Lever means are provided for actuating the gripping threads and after the driver means have operated to pass the weft threads through the shed of the loom, the end of the weft thread is brought into engagement with the suction orifice and the gripping threads are actuated by the lever means to engage and hold the weft thread ends against the suction orifice. After the weft threads have been placed in position against the suction orifice, they are retained therein by the action of suction and by the gripping threads. After the gripping threads have been released from engagement with the weft thread ends for subsequent engagement with other weft threads to be placed against the suction orifice, the original weft threads are retained in position on the suction orifice until loom operation has effected proper engagement of the weft threads between the warp threads of the loom shed.

The weft selection mechanism may further comprise a pawl pivotally mounted upon the second end of each of the weft selector arms with the selector means comprising means for selectively pivoting the pawl into and out of position for engagement with the actuating mechanism. The actuating mechanism may comprise a reciprocating slide mechanism reciprocally movable between a first and a second position with ratchet means being provided on the slide mechanism and adapted to engage the pawl when the selector means pivots the pawl into position for engagement with the actuating mechanism.

The actuating mechanism may further include an eccentric driving mechanism and connecting rod means interconnected between the slide mechanism and the eccentric mechanism to transmit a driving force to the slide mechanism from the eccentric driving mechanism, with said eccentric driving mechanism being selectively adjustable to control the action of the weft selector arms.

The selector means may comprise solenoids or electromagnets or other mechanical or electromechanical means suitably capable of performing the function of selectively pivoting the pawl attached to the selector arm which is to be actuated.

With regard to the weft retention mechanism, the basic concept involves achievement of the retention of the weft ends on a side or edge opposite that the side from which the threads are propelled, this being achieved by incorporating in the loom the suction nozzle accompanied by means for placing and holding the weft ends in the nozzle.

Each weft end is positioned and held in the suction nozzle immediately after it is driven through the loom shed thus avoiding retrogression of the weft after it is released by the driver before occurence of the action of the batten of the loom. The suction nozzle continues to retain the weft together with other weft threads until additional other wefts have been driven and retained whereby placement of the weft in the fabric enables achievement of its retention without the need of action by the nozzle. This mode of retention of the weft end without shed advance gives rise to many advantages relating to simplicity and efficiency of operation. Furthermore, added to these advantages are those derived from the fact that there does not occur interference with the action of the machine or prevention of the occasional backward movement of the operative loom to recover broken wefts. Additionally, finding of lost picks, degreasing or other adjustments necessary in other conventional modes of weft retention are eliminated.

The various features of novelty which characterize the invention are pointed out with particularity in the claims annexed to and forming a part of this specification. For better understanding of the invention, its operating advantages, and specific objects attained by its use, reference should be had to the accompanying drawings and descriptive matter in which there is illustrated and described preferred embodiments of the invention.

DETAILED DESCRIPTION OF THE PREFERRED EMBODIMENT

Figure 1:
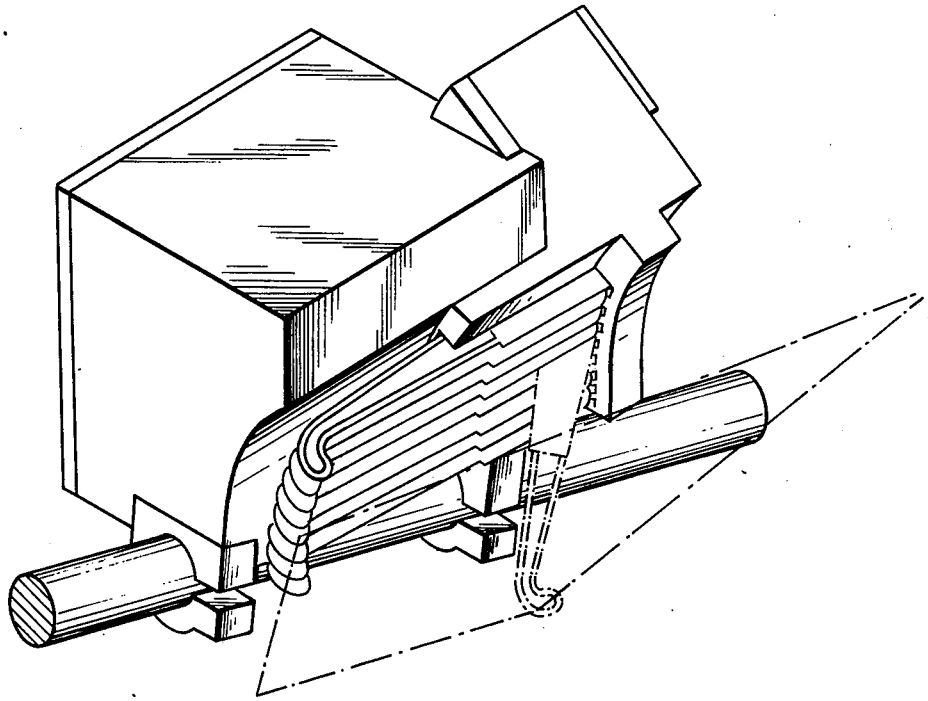
FIG. 1 is a perspective view of an assembly of the weft selector mechanism depicting the manner whereby the weft selector arms are arranged so that their ends engaging a weft thread will pass through an arc when the arms are pivoted, with the arcs through which each of the arm ends are passed, all passing through a common point.
Figure 2:
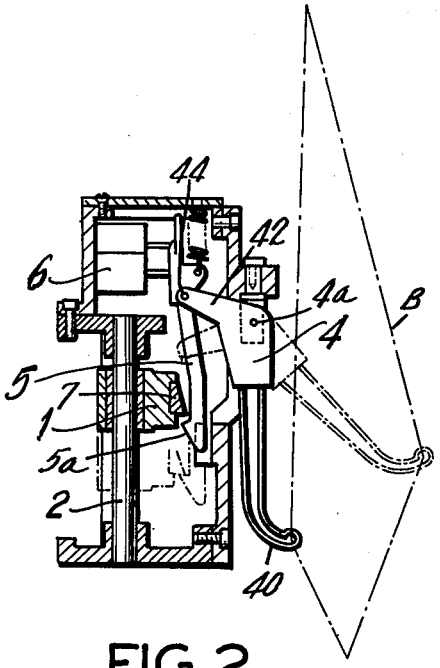
FIG. 2 is a plan view showing a section of the weft selector mechanism whereby there is illustrated the relationship between the weft selector arms, the selector means and the actuating means operating to select and actuate a particular weft selector arm.
Figure 7:
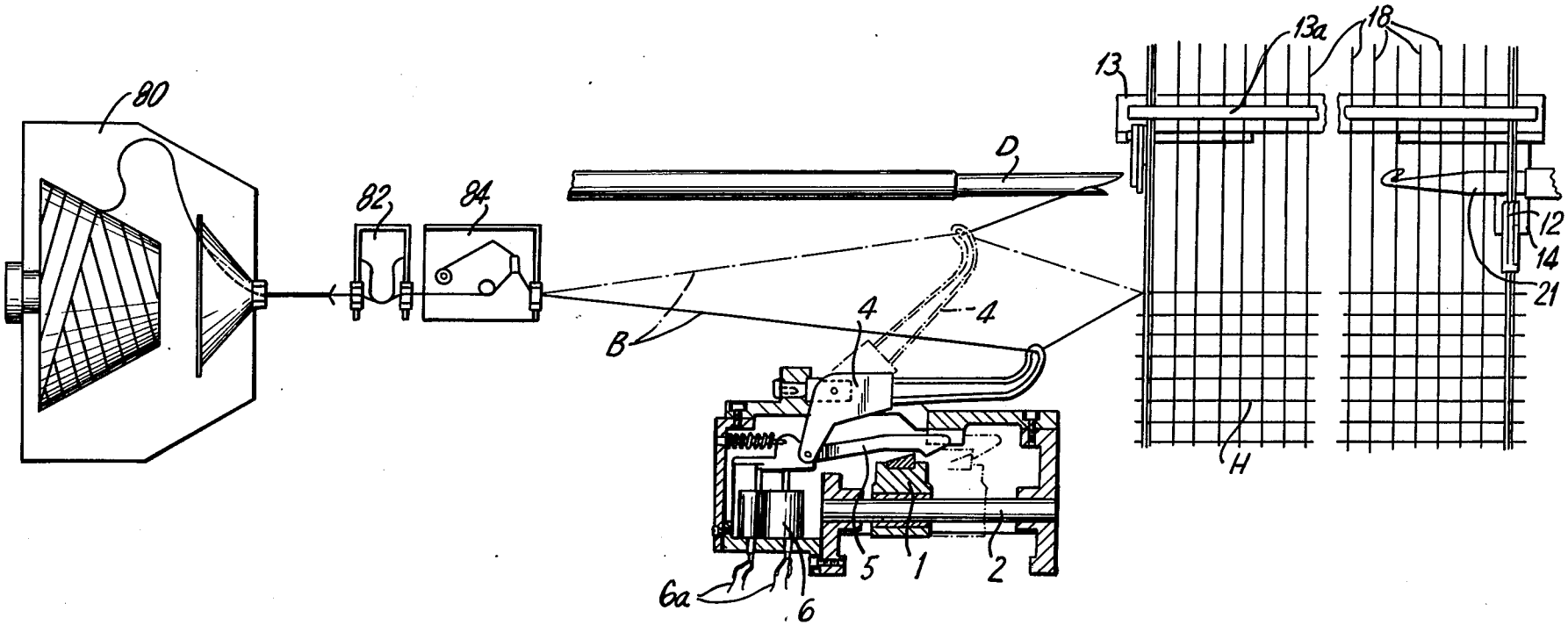
FIG. 7 is a schematic assembly view depicting the manner whereby the weft threads are selected and passed through the loom shed for subsequent engagement by the weft retention mechanism.

Referring now to the drawings, wherein like reference numerals are used to refer to similar parts throughout the various figures thereof, and particularly, FIGS. 1, 2 and 7, the weft selection mechanism of the invention is shown adapted for use with looms without a shuttle and comprising a plurality of pivotable weft selector arms 4. Each of the weft selector arms 4 is pivoted about a point 4*a* located intermediate a first end 40 and a second end 42 of the selector arm 4. The first end 40 of the selector arm 4 is in engagement with a weft thread shown in dotted form and as seen in FIG. 2, when the selector arm 4 is displaced from the position shown in solid line form to the position shown in dotted form, the arm thus moved will select the weft thread attached thereto by moving the thread to the dotted position in order to displace the thread for a phase shifted operation with relation to other threads thereby enabling the selected weft thread to be gripped easily and precisely.

Referring now to FIG. 7, it will be seen that when a weft thread B is selected by pivotal movement of the selector arm 4 from its solid line position to its dotted line position, the weft thread will be engaged by a weft inserter needle D which grips the end of the weft thread and delivers the weft for transfer to a fabric center and to a needle 21 which carries the weft to one side of a fabric H. The threads 18 constitute the warp of the loom and as the driver D passes the selected weft thread B through the sheds of the warp, the weft end is engaged by the needle 21 and passed to the opposite side, which is the right hand side as viewed in FIG. 7, of the loom shed where the thread may then be engaged by the weft retention mechanism.

The weft retention mechanism and its operation will be described more fully hereinafter but for the purposes of the present disclosure, it should be noted that the loom mechanism includes a sley 13 including a comb 13*a* operating in a conventional manner.

The warp threads 18 are conventionally arranged to be driven by the weave mechanism of the loom, and as the sheds thereof are intermittently separated, the weft threads B are passed therebetween for engagement by the driver 21 which brings the weft ends into engagement with the weft retention mechanism in a manner to be more fully described hereinafter.

The operation of the weft selection mechanism whereby a particular weft thread is selected by pivotal movement of the arm 4 involves a process wherein one of a plurality of the arms 4 must be selected and driven in a manner such that the thread attached to the first end 40 of the selected arm is phase shifted for engagement by the driver D for movement through the loom shed. The weft selection mechanism includes a slide 1 which is caused to be reciprocally moved along guide bars 2. The slide 1 includes a ratchet means 7 adapted to drivingly engage a pawl 5 which is pivotally attached to the second end 42 of the weft selector arm 4. The slide 1 is reciprocally moved along the guide bars 2 by operation of a rocker arm or lever 3 which is driven in a manner depicted in FIG. 3. As the slide 1 reciprocally moves along the guide bars 2, the claw or ratchet 7 may or may not engage the end 5*a* of a pawl 5 of a particular weft selector arm 4 depending upon the operating condition of selector means 6 which operate to pivot the pawl 5 about a point 44 at which the pawl is pivotally mounted to the second end 42 of the selector arm 4.

The weft selection mechanism includes a plurality of selector arms 4 each having a pawl 5 pivotally mounted thereon. When a particular pawl is to be selected, the selector means 6 is energized thereby causing pivotal movement of a pawl 5 in a clockwise direction about the point 44. This movement will bring the nose 5*a* of the pawl 5 beneath the ratchet or claw 7 and as the slide 1 moves downwardly, as viewed in FIG. 2, the ratchet 7 will engage the pawl nose 5*a* thereby causing pivotal rotation of the arm 4 about the pivot mounting 4*a*.

Figure 3:
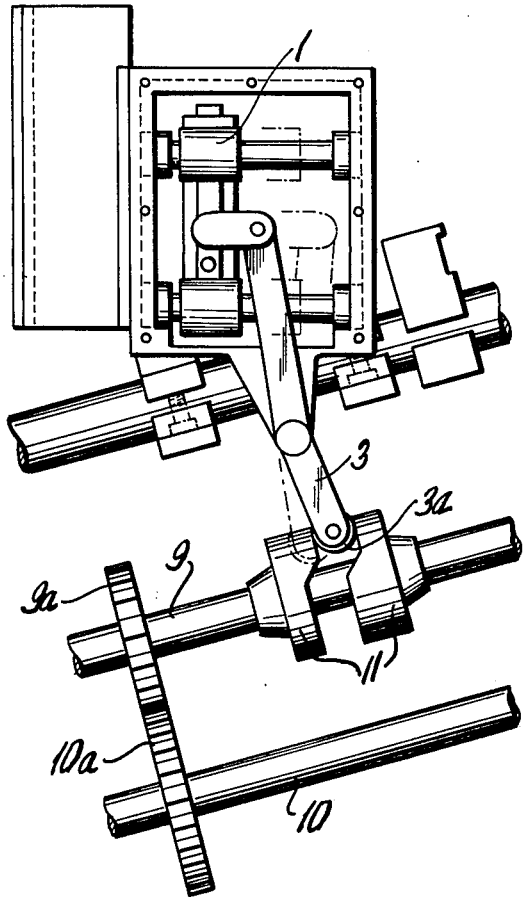
FIG. 3 is a side view showing part of the actuating mechanism of the device including a slide mechanism of the invention illustrating its movement in guideways actuated by a rocker arm.

The selector means 6 may comprise a solenoid or other electromagnetic means which may be selectively energized to selectively pivot a pawl 5 mounted upon a particular arm 4 whose selection is desired. If an electromagnet 6 is not actuated to cause a pawl 5 to become engaged with the claw or ratchet 7, the sliding movement of the slide 1 will not affect pivotting of an arm 4. When a weft thread is to be selected, the electromagnet 6 is appropriately energized and, as a result, the appropriate pawl 5 will be actuated causing engagement of the selected arm 4 with the actuating mechanism of the assembly. The weft selection mechanism is mounted upon a support 8 and the actuating mechanism including the slide 1 is driven by a device as best seen in FIG. 3 which includes an auxiliary shaft 9 arranged to be driven through a set of gears 9*a* and 10*a* having a 1 : 1 gear ratio by a cam shaft 10. The auxiliary shaft 9 has mounted thereon a cam 11 engaged by a cam follower 3*a* mounted upon an end of the rocker arm 3. The shaft 10 is a main driving shaft of the apparatus and imparts a driving force to the shaft 9 through the gears 10*a* and 9*a* whereupon rotation of the shaft 9 operates through engagement of the cam 11 and the cam follower 3*a* to actuate the rocker arm 3 thereby imparting thereto a reciprocating motion. This reciprocating motion of the arm 3 is imparted to the slide mechanism 1 which moves in a reciprocating manner continuously and effects driving of a selector arm 4 when a pawl 5*a* is appropriately brought into engaging position in the manner previously described.

Figure 5:
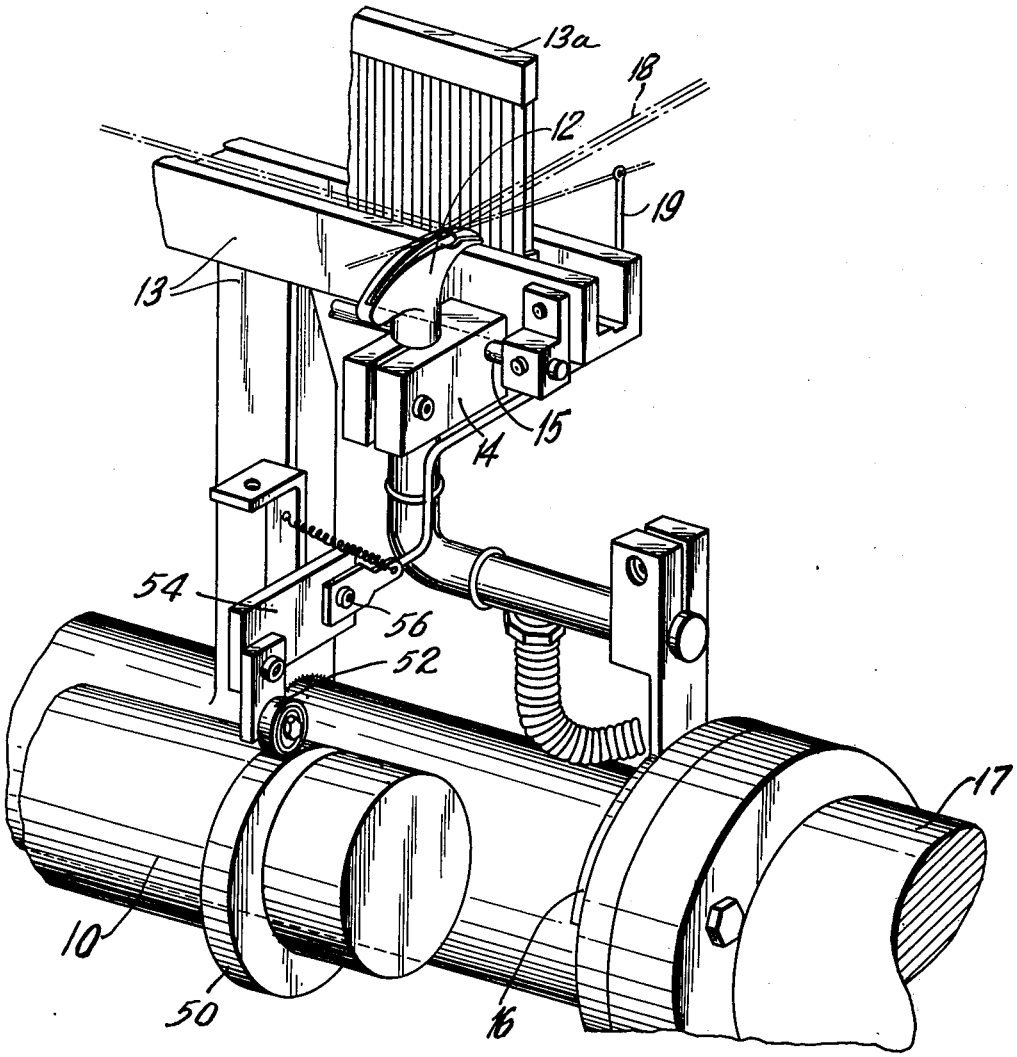
FIG. 5 is a perspective view showing the weft ends retention mechanism.
Figure 6:
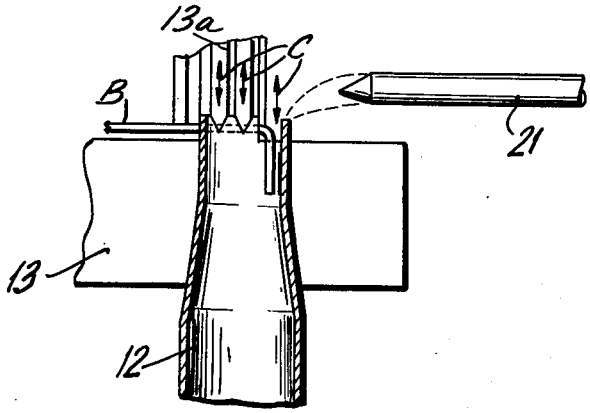
FIG. 6 is a detailed enlarged sectional view illustrating the suction nozzle of the weft retention mechanism and depicting the manner whereby engagement and retention of the weft ends therein may be accomplished.

As previously mentioned, after the selected weft thread B is engaged by the driver D and passed through the warp threads 18, it is engaged by the needle 21 and brought into engagement with the weft retention mechanism. The weft retention mechanism is best shown in FIGS. 5 and 6. The needle 21, as seen in FIG. 6, engages the selected weft thread and draws it into engagement with a suction nozzle 12 mounted to move together with the batten 13 of the loom. The mounting device for the weft retention mechanism involves an assembly which consists of a holding clamp 14 having the suction nozzle 12 mounted thereon, a supporting rod 15 and a sector 16 bearing upon a shaft 17 of the batten 13.

By virtue of the special mounting arrangement of the invention, there is permitted manual control of the positioning of the nozzle 12 in a transverse direction, thereby permitting it to be placed adjacent the edge of a fabric which is to be manufactured without regard or without limitation as to the width of the fabric. The nozzle 12, which moves together with the batten 13, is mounted for cooperative relationship with gripping threads C which are actuated by a lever 19 included in a mounting similar to the mounting of the nozzle 12. However, the lever 19 is connected by a sleeve with a cam of the drive shaft 10 which produces an alternating vertical movement.

As a weft thread B is gripped by the needle 21 and drawn toward the nozzle 12, the lever 19 is raised and in that position it holds the gripping threads C away from the nozzle 12 so that the driver or needle 21 carrying the weft end may pass between the gripping threads C through the warp threads 18 and be brought into engagement with the nozzle 12. After this action has been effected, the lever 19 is moved downwardly thereby moving with it the gripping threads C which are brought against the nozzle 12. As a result, the weft end which has been delivered to the nozzle 12 by the driver or needle 21 is caught and held against the nozzle 12 by the gripping threads C and is caused to penetrate thereinto so that it may be retained by the suction force created therein acting together with the force supplied by the threads C. With this operation having been completed, the threads C are raised by the lever 19 and proceed to engage a next weft thread which is to be brought into engagement with the nozzle 12 by the needle 21. The weft thread which has been previously engaged in the suction nozzle 12 will be retained there despite the fact that the gripping threads C have been disengaged therefrom by operation of the lever 19.

The warp threads 18 are conventionally arranged to be driven by the weave mechanism of the loom, and as the sheds thereof are intermittently separated, the weft threads B which are selected are passed between the warp threads 18 for engagement by the needle 21 which brings the weft ends under the gripping threads C and into engagement with the nozzle 12. After this operation has been completed, and the lever 19 is raised with the previously selected weft end being held in engagement within the nozzle 12, subsequent movement of the batten 13 and operation of the warp threads 18 by the conventional loom mechanism brings the apparatus into position for selection and retention of another weft thread.

Thus, it will be seen that in the general overall operation of the device, weft threads are first delivered for retention by the nozzle 12 of the weft retention mechanism. With the weft threads in place for retention by the nozzle 12, the weft selector mechanism including the selector arms 4 may be operated in order to select the individual weft threads during operation of the apparatus and the comb 13*a* is activated in order to form the fabric.

The mechanism which operates the lever 19 is depicted in FIG. 5 and as shown therein, the raising and lowering of the eye of the lever 19 is effected by an eccentric cam 50 which is engaged by a cam follower 52. A rocker arm 54 is pivoted about a pivot point 56 and by rotation of the cam 50, the rocker arm 54 pivots about the point 56 to raise and lower the lever 19.

Figure 4:
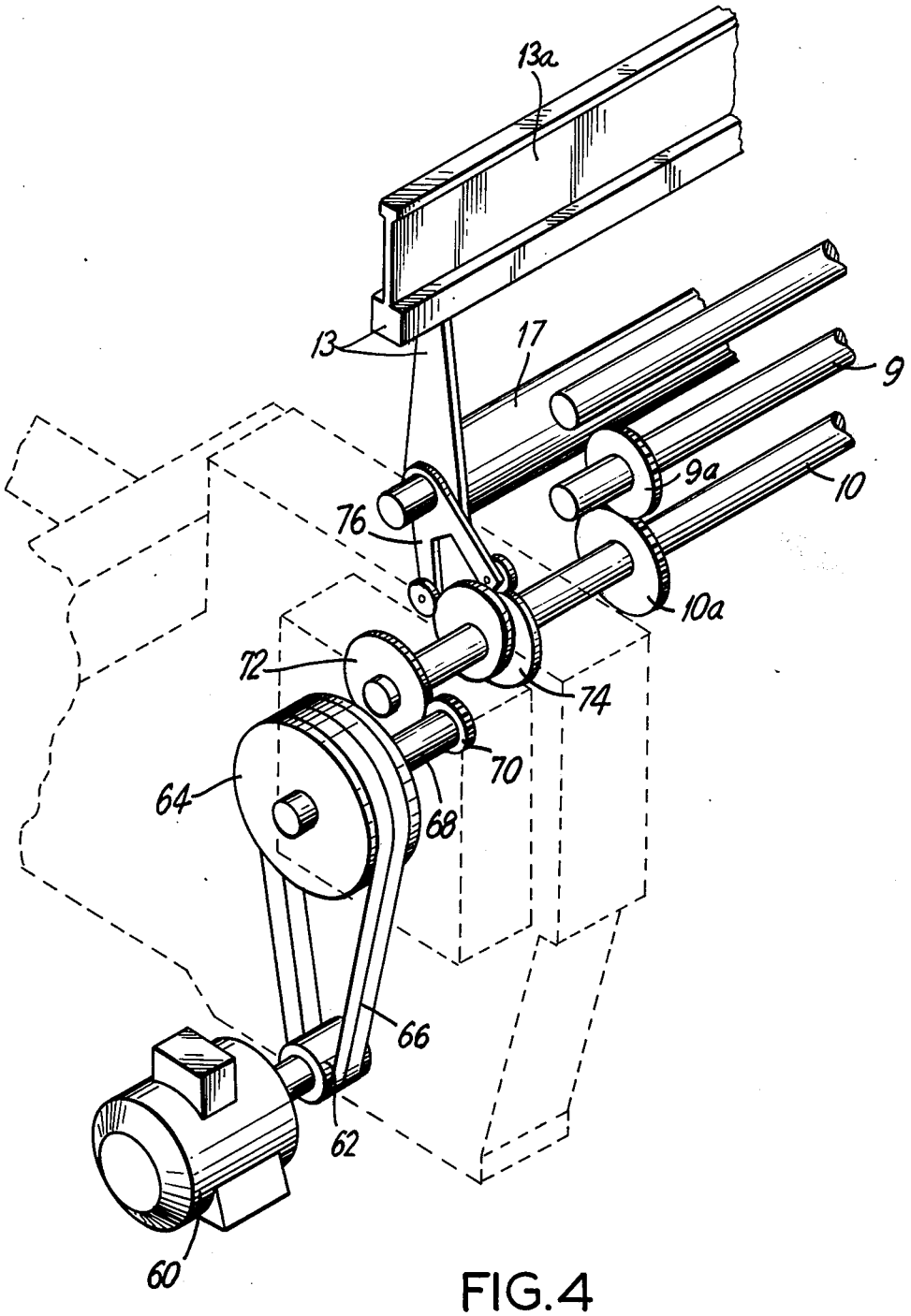
FIG. 4 is a schematic perspective view illustrating the overall drive means of the loom.

The cam 50 is attached to the shaft 10 which is the main driving shaft of the apparatus. The overall driving mechanism for the shaft 10, as shown in FIG. 4, includes a main motor 60 and a pulley drive 62 which operates through appropriate gearing to drive the various elements of the apparatus which are interconnected to operate in a given relationship relative to each other. The pulley 62 drives a second pulley 64 through belts 66 with a shaft 68 being driven by rotation of the pulley 64. A pair of gears 70 and 72 operate to impart driving motion of the shaft 68 to the main shaft 10. The batten 13 of the loom is arranged for driving engagement with cams 74 which operate to actuate a sley interlocked follower 76 for actuation of the basic loom mechanism.

As will be seen, the shaft 9 depicted in FIG. 3 is also shown in FIG. 4 and the means whereby the rocker 3 and the arm 5 are actuated will be clear from a comparison of these figures. Furthermore, it will be seen that the weft selector mechanism including the selector arms 4 operates in conjunction with the weft retention mechanism shown in FIG. 5. Referring to the mechanism depicted in FIG. 5, it will be seen that the weft threads are indicated as the threads B and that they extend into the batten 13. The warp yarns 18 driven by the weave mechanism of the loom are illustrated in FIG. 5 and by reference to FIG. 7, it will be seen that as the arm 4 selects a weft thread, it is brought between the warp threads 18 into engagement with the nozzle 12 shown in FIG. 5 by the driver or needle 21.

The motion of the batten 13 is a conventional motion similar to that which is effected in all looms. That is, a forward and rearward reciprocating motion is involved. The nozzle or tube 12 has formed at the top thereof a serrated configuration where the weft end is trapped when the retaining yarns C strung in the eye of the lever 19 are lowered. The nozzle assembly is fixed directly to a positioning clamp 14 wherein a stud 15 attached to a block of the batten 13 is projected. The opposite end of the nozzle or tube 12 is formed in the shape of an ellbow and is fixed to a clamp projecting from the segment 16 resting upon the shaft 17. The segment 16 slides over the shaft 17 by virtue of the reciprocating motion of the batten 13. The driver 21 is essentially the lance of the loom and operates as a weft holder lance until the weft is brought into engagement with the nozzle 12 whereby the weft is retained by the yarns C in the manner previously discussed.

Reciprocation of the selector arms 4 may be determined by a program (not shown) which appropriately actuates the electromagnets or selection means 6 which in turn, through the slider 1 and the pawl 5 actuate the respective arms which, consequently, reciprocate so that the ends thereof having the weft threads engaged therein, pass through a common point during the arching movement of the arms 4.

The feed mechanism for the weft threads B is shown in FIG. 7 as including a weft coreholder creel 80 from which weft threads are brought to a weft stop motion mechanism 82 and from there through a weft compensator 84. The solenoids 6 include wiring leads *6a* through which the solenoids may be attached to an appropriate programming device in order to energize in a selected fashion individual solenoids so that individual pawls 5 may be actuated to cause engagement with the slide 1 thereby effecting appropriate selective pivotal motion of an arm 4.

It is to be understood that the suction effect which is created by the nozzle 12 serves to retain leftover ends of the threads so that the assembly may operate appropriately without the threads C being held in constant engagement with the nozzle in order to achieve proper functioning with respect to the actual retention of the weft end of the threads.

The selvage of the fabric which is to be formed will, accordingly, involve loosely hanging weft ends inasmuch as the gripping threads C are utilized merely to hold the weft ends against the nozzle 12. The gripping threads C are not formed as a shed in the same manner as the warp threads 18 and thus, as the fabric moves from the loom, loosely hanging weft ends will be produced inasmuch as the weft threads are not interwoven with the gripping threads.

It will be appreciated from the foregoing that the invention may, in essence, be applied in other forms of apparatus which differ only in detail from the apparatus which is indicated herein for exemplary purposes. The mechanisms of selection and retention may therefore by manufactured with the most adequate means in materials and with the most suitable accessories all of which may fall within the spirit and scope of the invention.

While specific embodiments of the invention have been shown and described in detail to illustrate the application of the inventive principles, it will be understood that the invention may be embodied otherwise without departing from such principles.

What is claimed is:

1. Apparatus for selection of weft threads in looms operating without a shuttle comprising a plurality of weft selector arms each having a first end in engagement with a weft thread and a second end, means pivotally mounting each of said arms at a point intermediate said first and second ends, with said plurality of arms arranged to have said first end of each arm pass through a common point during pivotal movement about said intermediate point, pawl means pivotally mounted on said second ends of said selector arms, reciprocating drive means, and electro magnetic selector means for selectively pivoting said pawl means into driving engagement with said reciprocating drive means for selectively individually pivoting each of said arms, with pivotal motion of said arms as a result of selective engagement of said pawl means with said drive means operating to effect selection of a weft thread in engagement with said first end of said selected arm.

2. Apparatus according to claim 1, wherein said pawl means comprise an individual pawl pivotally mounted upon said second end of each of said plurality of weft selector arms, said selector means comprising means for individually selectively pivoting each of said pawls into and out of position for engagement with said drive means.

3. Apparatus according to claim 2 wherein said drive means comprises a reciprocating slide mechanism and ratchet means on said slide mechanism adapted to engage said pawl when said selector means pivots said pawl into position for engagement with said actuating mechanism to enable said reciprocating slide mechanism by engagement with said pawl to effect rotation of a selected weft selector arm.

4. Apparatus according to claim 3 wherein said drive means further includes an eccentric driving mechanism and connecting rod means interconnected between said slide mechanism and said eccentric mechanism to transmit a driving force to said slide mechanism from said eccentric driving mechanism, said eccentric driving mechanism being selectively adjustable to control the action of said weft selector arm.

5. A loom assembly operating without a shuttle comprising a plurality of weft selector arms each having a first end in engagement with a weft thread and a second end, means pivotally mounting each of said arms at a point intermediate said first and second ends with said plurality of arms arranged to have said first end of each arm pass through a common point during pivotal movement about said intermediate point, reciprocating drive means, selector means, and means actuated by said selector means for selectively individually engaging each of said arms with said drive means for driving engagement therewith, with pivotal motion of said arms as a result of selective engagement with said drive means operating to effect selection of a weft thread in engagement with said first end of said selector arm, retention means defining a suction orifice within which said selected weft thread may be retained by means of a suction force supplied thereto, means mounting said retention means for transverse movement relative to said loom assembly, means for providing gripping threads, lever means for actuating said gripping threads, driver means for controlling positioning of said selected weft threads relative to said suction orifice, said driver means operating to pass said selected weft thread from said first end of said selector arm to between said suction orifice and said gripping threads, said gripping threads being actuated by said lever means to engage said weft threads and place said weft threads against said suction orifice after said weft threads have been passed by said driver means between said suction orifice and said gripping threads, said suction orifice being adapted to retain said weft threads therein by suction action after said gripping threads have been released from engagement with said weft threads for subsequent engagement with other selected weft threads to be placed against said suction orifice.

* * * * *